US008246824B2

(12) United States Patent
Larin

(10) Patent No.: US 8,246,824 B2
(45) Date of Patent: Aug. 21, 2012

(54) WASTE GREASE DISPOSAL BIN

(76) Inventor: Benoit Larin, Salaberry-De-Valleyfield (CA)

( * ) Notice: Subject to any disclaimer, the term of this patent is extended or adjusted under 35 U.S.C. 154(b) by 374 days.

(21) Appl. No.: 12/623,125

(22) Filed: Nov. 20, 2009

(65) Prior Publication Data

US 2011/0120996 A1 May 26, 2011

(51) Int. Cl.
*B65F 3/04* (2006.01)
*B65F 1/12* (2006.01)
*B65F 1/14* (2006.01)

(52) U.S. Cl. ..... 210/237; 210/241; 210/249; 210/251; 210/475; 220/810; 220/254.1; 220/254.3; 220/729; 220/367.1; 220/745; 220/371; 220/DIG. 23; 294/68.1; 294/68.26; 414/406; 414/408; 414/410

(58) Field of Classification Search ..... None
See application file for complete search history.

(56) References Cited

U.S. PATENT DOCUMENTS

| | | | | | |
|---|---|---|---|---|---|
| 1,554,589 | A | | 9/1925 | Long | |
| 1,831,687 | A | * | 11/1931 | Ross | 232/43.1 |
| 2,376,874 | A | | 5/1945 | Henry | |
| 3,373,522 | A | * | 3/1968 | Staubly | 43/55 |
| 3,837,512 | A | * | 9/1974 | Brown | 414/406 |
| 4,237,857 | A | * | 12/1980 | Sharp, Sr. | 126/343.5 A |
| 4,319,762 | A | | 3/1982 | Streit | |
| 4,360,046 | A | | 11/1982 | Streit | |
| 4,450,828 | A | * | 5/1984 | Onken et al. | 126/343.5 A |
| 4,485,831 | A | | 12/1984 | Ungerleider | |
| 4,555,339 | A | * | 11/1985 | Graves et al. | 210/244 |
| 4,624,468 | A | * | 11/1986 | Onken | 280/43.2 |
| 4,699,557 | A | * | 10/1987 | Barnes | 414/408 |
| 4,733,650 | A | * | 3/1988 | Triggs | 126/343.5 A |
| 4,778,209 | A | * | 10/1988 | Zosky et al. | 294/68.27 |
| 4,823,947 | A | | 4/1989 | Maynard | |
| 4,874,103 | A | * | 10/1989 | Quisenberry et al. | 220/254.3 |
| 5,054,640 | A | * | 10/1991 | Tucker | 220/716 |
| 5,120,454 | A | | 6/1992 | Wieties | |
| 5,183,180 | A | | 2/1993 | Hawkins | |
| 5,718,220 | A | * | 2/1998 | Onken | 126/343.5 A |
| 5,908,551 | A | * | 6/1999 | Onken | 210/184 |
| 5,911,346 | A | * | 6/1999 | Onken | 222/571 |
| 6,227,405 | B1 | * | 5/2001 | Andreoli et al. | 220/840 |
| 6,981,498 | B2 | * | 1/2006 | Onken | 126/343.5 A |
| D620,218 | S | * | 7/2010 | Larin | D34/1 |
| D625,893 | S | * | 10/2010 | Larin | D34/1 |
| 2008/0149553 | A1 | * | 6/2008 | Sowerby et al. | 210/301 |
| 2010/0108675 | A1 | * | 5/2010 | Meissen et al. | 220/254.3 |
| 2010/0294730 | A1 | * | 11/2010 | Weston | 210/767 |
| 2011/0120996 | A1 | * | 5/2011 | Larin | 220/212 |

* cited by examiner

*Primary Examiner* — Robert James Popovics

(57) ABSTRACT

A grease waste container has a main body forming an interior space; the container having vertical side walls, an enclosed base end, and an upper end that is wider than the base end. The upper end including a removable cover that is capable of releasably enclosing the interior space, and at least one bracket member attached to one of the vertical side walls and including an upper pin and a lower pin both adapted to releasably connect to a lifting system of a grease removal truck.

4 Claims, 6 Drawing Sheets

WASTE GREASE DISPOSAL BIN

FIELD OF THE INVENTION

The present invention relates generally to waste containers but more particularly to an improved container for collecting and disposing of waste grease products.

BACKGROUND OF THE INVENTION

Commercial establishments such as restaurants which use cooking oil and grease to cook and fry food products are required by law to dispose of their used grease in an environmentally friendly manner. This prevents waste grease from being dumped into the sewage and further polluting the environment.

Restaurants and similar establishments currently empty their waste grease regularly into metal containers or bins so that they can be disposed off in a proper manner. There are grease disposal companies, which send their trucks to these establishments on a regular basis to pick up this waste grease in order to dispose of it suitably or recycle it in most cases. These trucks traditionally pick up the grease containers much like garbage trucks pick up dumpsters and they then dump the grease into their tank. They then leave the containers behind at the site where it can be reused.

This system works well in warm climates as the grease is in liquid or semi-liquid form and is able to flow easily out of the grease containers into the truck's tank. In cold climates the trucks have to carry hot water, generally heated using propane which they first immerse the metal grease bins into for the grease to melt a bit before they are able to dump it into their carrying tank. This is a time consuming operation, which besides requiring energy to heat the water also reduces the trucks carrying capacity.

There is a need for a better way to collect grease and oil from restaurant.

SUMMARY OF THE INVENTION

In view of the foregoing disadvantages inherent in the known devices now present in the prior art, the present invention, which will be described subsequently in greater detail, is to provide objects and advantages which are:

To provide for a grease waste bin composed of plastic or similar material and designed such that its base is narrower than its top. This ensures that the grease, even as a frozen block will easily come out of the bin as grease does not adhere to plastic like it does to metal.

Another advantage of this invention is to have a metal connecting bracket or support, which is attached to the grease waste bin allowing it to be easily connected to the grease truck lifting system. This enables the truck to safely lift a plastic container without causing damage to it.

To attain these ends, the present invention generally comprises a grease waste container having a main body forming an interior space; the container having vertical side walls, an enclosed base end, and an upper end that is wider than the base end. The upper end including a removable cover that is capable of releasably enclosing the interior space, and at least one bracket member attached to one of the vertical side walls and including an upper pin and a lower pin both adapted to releasably connect to a lifting system of a grease removal truck.

In a preferred embodiment, the grease waste container has its upper end that is larger than the base end in each comparative direction, and is adapted such that if grease solidifies within the container the container can simply be turned upside down and the solidified grease can be easily removed.

The removable cover includes an opening therein adapted to allow grease to pass therethrough; the opening includes a grill removably attached therein and is adapted to filter out unwanted items from the grease as it passes therethrough. The removable cover further includes a pivotable secondary cover that is adapted to removably cover the opening.

Preferably, a second bracket member attached to an opposite vertical side wall of the container from a first of the at least one bracket member, and also including an upper pin and a lower pin both adapted to releasably connect to a lifting system of a grease removal truck.

At least one bracket member is formed including a C-channel for increasing its strength and rigidity, and holes adapted to receive fasteners for securely attaching the bracket member to one of the vertical side walls of the container.

The material chosen to form the main body, the removable cover, and the pivotable secondary cover is chosen from a list of materials including plastic, PVC, polymers, fiberglass, glass, graphite, and composites thereof.

A combination of a grease removal truck and a grease waste container has a grease removal truck including a lifting system, and a grease waste container comprising a main body forming an interior space. The container having vertical side walls, an enclosed base end, and an upper end that is wider than the base end. The upper end including a removable cover that is capable of releasably enclosing the interior space, and at least one bracket member attached to one of the vertical side walls and including an upper pin and a lower pin both adapted to releasably connect to the lifting system of the grease removal truck.

A method of grease removal truck comprising the steps of providing a grease waste container comprising a main body forming an interior space. The container having vertical side walls, an enclosed base end, and an upper end that is wider than the base end. The upper end including a removable cover that is capable of releasably enclosing the interior space and including an opening therein adapted to allow grease to pass therethrough. The opening includes a grill removably attached therein and is adapted to filter out unwanted items from the grease as it passes therethrough. The removable cover further includes and at least one bracket member attached to one of the vertical side walls and including an upper pin and a lower pin both adapted to releasably connect to a lifting system of a grease removal truck; and providing a grease removal truck including a lifting system adapted to lift the grease waste container and dump the grease therein, such that when grease needs to be removed from an area, the grease waste container is prepared by opening the pivotable secondary cover, pouring the grease through the opening and grill of the removable cover, closing the pivotable secondary cover, removing the removable cover, attaching the grease waste container to hooks that form an integral part of the lifting system of the grease removal truck, allowing the grease removal truck to lift and pour the grease therein, removing the grease waste container from the lifting system of the grease removal truck, and then properly storing the grease waste container for further use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
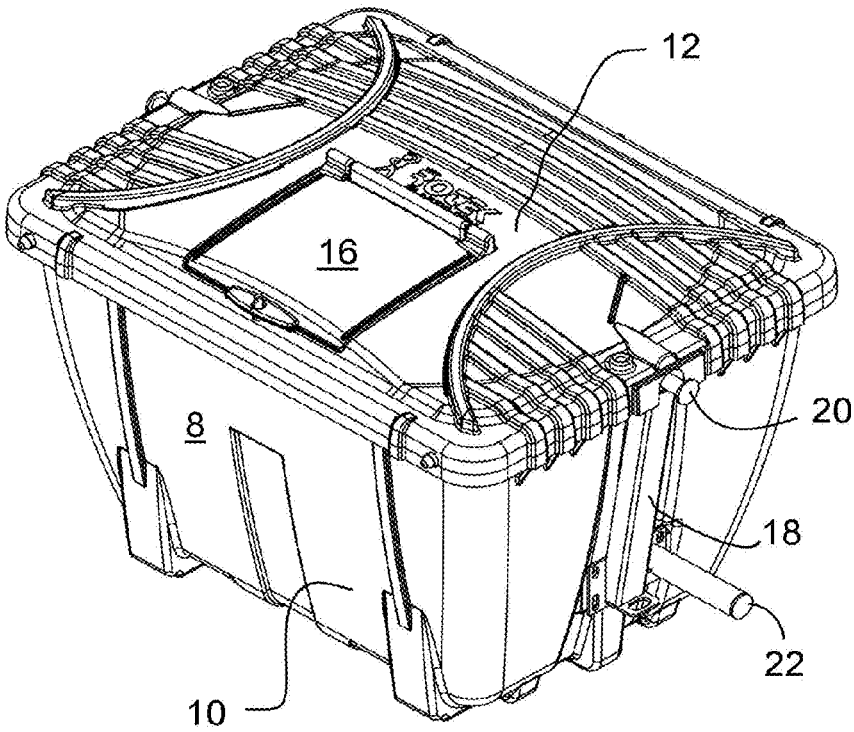
FIG. 1 Isometric view of the invention.
Figure 2:
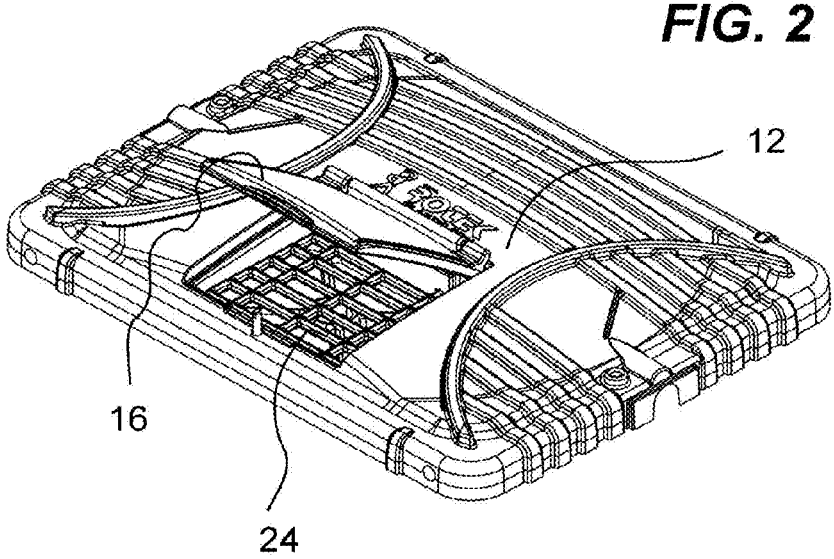
FIG. 2 Isometric view of the top lid.
Figure 3:
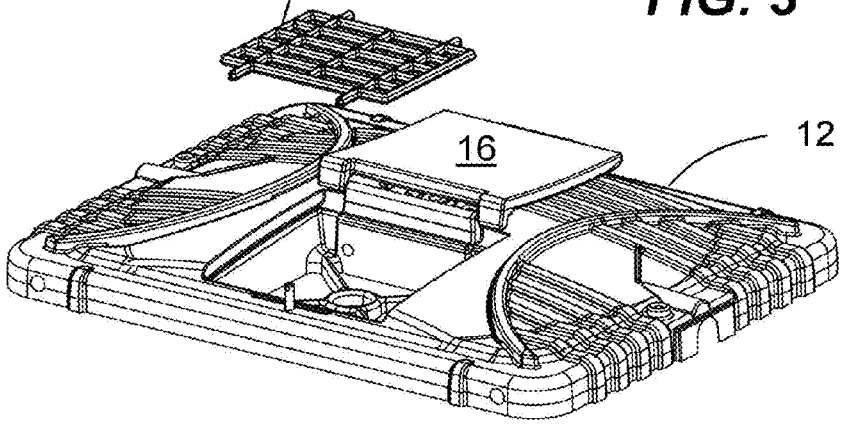
FIG. 3 Isometric view of the top lid.
Figure 4:
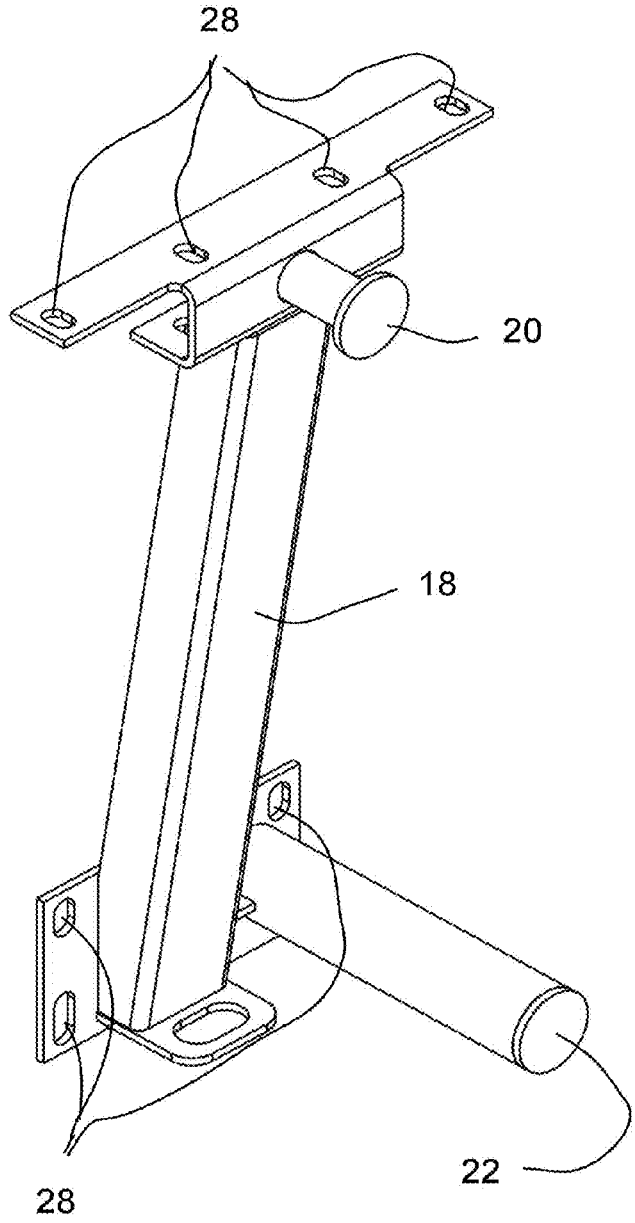
FIG. 4 Isometric view of the metal bracket.
Figure 5:
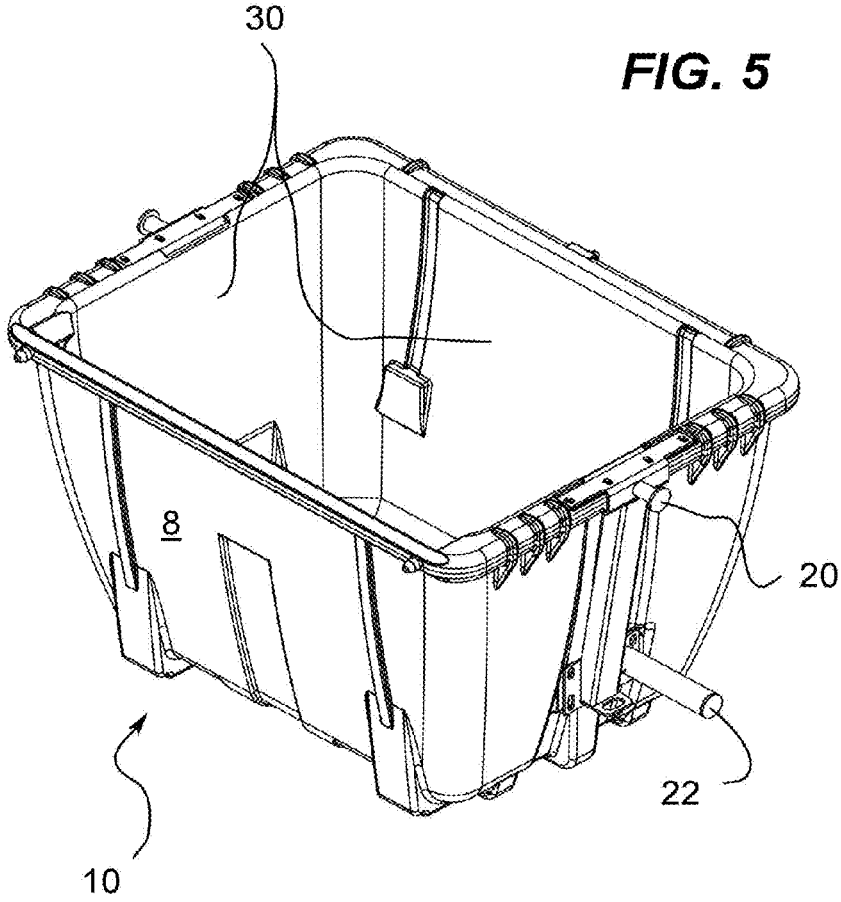
FIG. 5 Isometric view of the invention without top lid.

A grease waste bin (10) used to store waste grease (not shown) comprising a body (8) having a bottom part that is narrower in dimension than its top, consisting of an outer lid (12) and one smaller lid (16) built into the outer lid's (12) surface. The smaller lid (16) is hinged allowing it to swivel open, revealing a grill (24) built into the opening underneath. In a preferred embodiment, the grill (24) is removably attached.

Figure 6A:
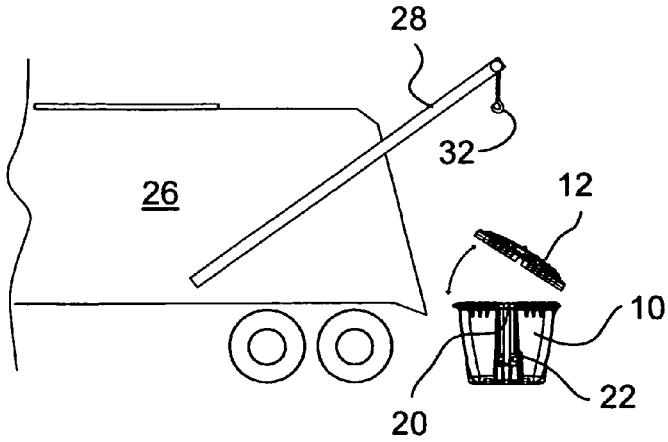
FIG. 6A-*f* Side views showing the waste bin emptying sequence.
Figure 6B:
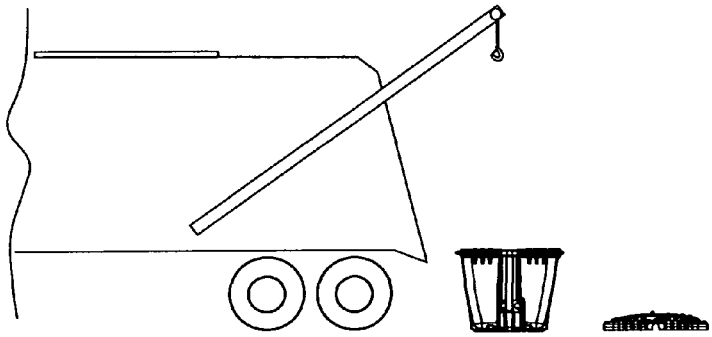
Figure 6C:
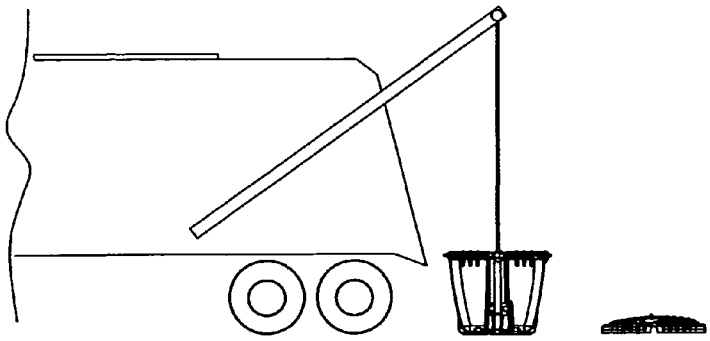
Figure 6D:
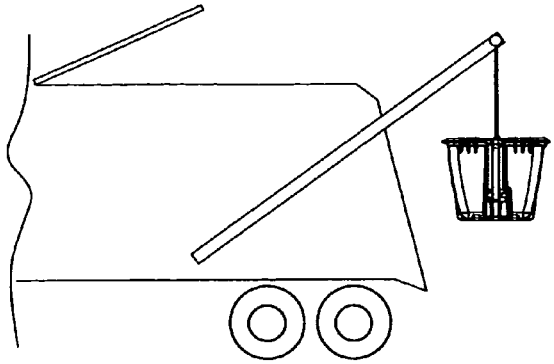
Figure 6E:
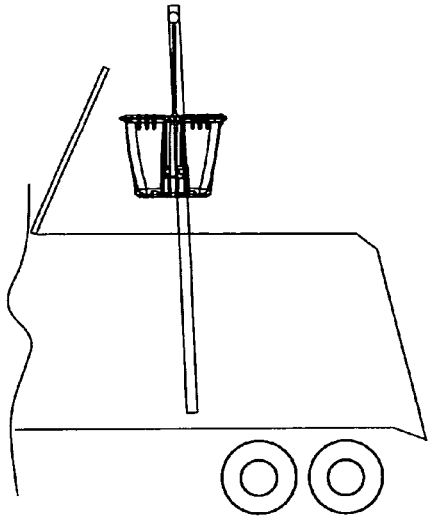
Figure 6F:
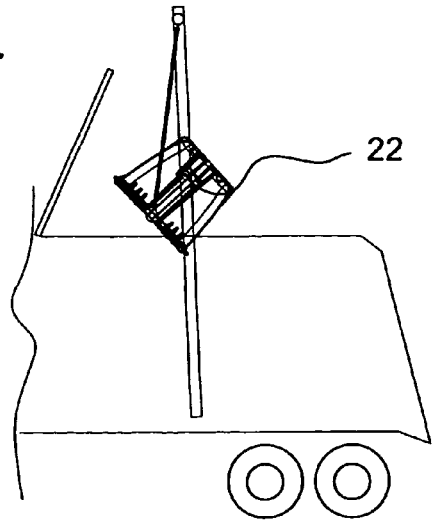

A metal bracket (18) is fixedly attached to each side of the grease waste bin (10) by way of mechanical fasteners (not shown) passing through holes (28) made into the metal bracket (18). The metal bracket (18) has an upper pin (20) and a lower pin (22) protruding from it which allows for a hydraulic lifting beam (28) located on a grease removal truck (26) to use its hooks (32) (only one shown in the figures) to hook up with the upper pins (20) in order to lift the grease waste bin (10) up and over the grease removal truck (26). At this point, as shown in FIG. 6*f*, the lower pins (22) abut against the lifting beam (28) which tilts and upturns the grease waste bin (10) and empties its content into the grease removal truck (26). The metal bracket (18) consists mainly of a "C" channel for structural integrity.

Waste grease (not shown) is generally poured into the grease waste bin (10) by lifting the flap or smaller lid (16) located on the surface of the larger outer lid (12) of the grease waste bin (10). The outer lid (12) is then manually removed for pick up by the collection truck (26).

Because of the tapered shape of the grease waste bin (10), wherein the bottom part is narrower in dimension than the top, the waste grease (not shown) can easily slide off the vertical side walls (30) of the grease waste bin (10), even when frozen solid, without the need for heating or immersion in hot water, as is the current procedure in cold temperatures.

Once emptied, the grease waste bin (10) is lowered back to its initial position on the ground where the outer lid can be manually re-installed. The grease waste bin (10) can then be returned to its original location where it can be used again.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A grease collection system comprising:

a truck including a lifting system for lifting a grease waste container;

a grease waste container including:

a main body defining an interior space, said main body having vertical side walls, an enclosed base end, and an upper open end that is wider than said base end;

a removable cover that is capable of releasably enclosing said interior space, said removable cover includes an opening therein capable of allowing grease to pass therethrough, said opening including a grill releasably attached therein and capable of filtering out unwanted items from the grease as it passes therethrough, said removable cover further includes a secondary pivotable cover that removably covers said opening; and at least one bracket member attached to one of said vertical side walls and including an upper pin and a lower pin both constructed to releasably connect to said lifting system of said grease removal truck.

2. The grease collection system of claim 1, further comprising a second bracket member attached to a vertical side wall opposite from said at least one bracket member, and also including an upper pin and a lower pin both capable of releasably engaging said lifting system of said grease removal truck.

3. The grease collection system of claim 1, wherein said at least one bracket member is formed including a C-channel for increasing its strength and rigidity, and holes constructed to receive fasteners for securely attaching said bracket member to one of said vertical side walls of said container.

4. The grease collection system of claim 1, wherein said main body, said removable cover, and said pivotable secondary cover are made from a material selected from the group consisting of PVC, polymers, fiberglass, glass, graphite, and combinations thereof.

* * * * *